US008671473B1

(12) United States Patent
Morrone

(10) Patent No.: US 8,671,473 B1
(45) Date of Patent: Mar. 18, 2014

(54) LAUNDRY TUB WITH OVERFLOW DRAIN

(76) Inventor: Michael Morrone, Howell, MI (US)

( * ) Notice: Subject to any disclaimer, the term of this patent is extended or adjusted under 35 U.S.C. 154(b) by 768 days.

(21) Appl. No.: 12/881,272

(22) Filed: Sep. 14, 2010

(51) Int. Cl.
*E03C 1/24* (2006.01)

(52) U.S. Cl.
USPC ..... 4/651

(58) Field of Classification Search
USPC ..... 4/619, 650–652
See application file for complete search history.

(56) References Cited

U.S. PATENT DOCUMENTS

| | | | | |
|---|---|---|---|---|
| 495,480 | A | 4/1893 | Giles | |
| 1,416,172 | A | 5/1922 | Connolly | |
| 1,931,632 | A | 10/1933 | Stoddard | |
| D175,850 | S | 10/1955 | Mustee | |
| 2,780,241 | A | 2/1957 | Mustee | |
| 3,333,282 | A | 8/1967 | Mustee | |
| 3,859,675 | A | 1/1975 | Van Manen et al. | |
| 4,231,123 | A * | 11/1980 | Cheng | 4/651 |
| 4,777,676 | A | 10/1988 | Ericson | |
| D318,523 | S | 7/1991 | Blanc et al. | |
| D368,514 | S | 4/1996 | Crepeau et al. | |
| 5,819,335 | A | 10/1998 | Hennessy | |
| D545,409 | S | 6/2007 | Plikuhn | |
| D560,771 | S | 1/2008 | Kitsmiller et al. | |
| 2004/0034926 | A1 * | 2/2004 | Ball | 4/680 |

OTHER PUBLICATIONS

Inset Laundry Tubs. Lakeland Affordable Sinks. http://www.lakelandsinks.com.au/insert-laundry-tubs.cfm. Accessed Dec. 4, 2009.

Twist Type Leverwaste with Overflow for Utility Sink. Potracksource. http://www.potracksource.com/twistlevovrlw.html. Accessed Dec. 4, 2009.

* cited by examiner

*Primary Examiner* — Huyen Le
(74) *Attorney, Agent, or Firm* — Robert C. Montgomery; Montgomery Patent & Design

(57) ABSTRACT

A laundry tub apparatus with an overflow drain comprising an aperture located along an upper portion of a side wall and an overflow assembly is herein disclosed. The apparatus comprises a basin assembly, an overflow drain assembly, and a bottom drain assembly. The basin assembly comprises a tub, a bottom drain, and a faucet assembly. An overflow aperture is located in a side wall of the tub, further comprising an elbow which directs overflow water to the bottom drain assembly below the tub, thereby providing normal drainage into a waste system rather than completely filling the tub and spilling out.

12 Claims, 5 Drawing Sheets

LAUNDRY TUB WITH OVERFLOW DRAIN

RELATED APPLICATIONS

The present invention was first described in a notarized Official Record of Invention on Oct. 13, 2009, that is on file at the offices of Montgomery Patent and Design, LLC, the entire disclosures of which are incorporated herein by reference.

FIELD OF THE INVENTION

The present invention relates generally to laundry basins, and in particular, to a drain assembly adapted to prevent overflowing of water from such basins.

BACKGROUND OF THE INVENTION

Laundry basins are common fixtures in households. These freestanding tubs are commonly found in laundry rooms due their use in conjunction with automatic laundry machines and the like. Such basins provide a means for receiving water drained from laundry machines, and often also provide a faucet for selective water flow. The presence of such basins in laundry rooms or other out-of-the-way locations and their relatively large size means that they are often utilized for large, messy cleaning tasks unsuitable for smaller sinks around a house.

One (1) problem associated with these tubs is the fact that they are often in use while a user is not present. Use with automatic laundry machines results in large amounts of water deposited in the basin, often with no one present. Furthermore, their use in particularly dirty and time-consuming tasks means that such basins are often subject to large amounts of dirt and debris over a period of time. The failure of such basins to drain is particularly problematic due to the large volumes of water involved and the fact that their remote and automatic usage means that an overflow of water may go undetected for a substantial amount of time.

Various attempts have been made to provide a drainage means to water basin structures. Examples of these attempts can be seen by reference to several U.S. patents. U.S. Pat. No. 495,480, issued in the name of Giles, describes an overflow assembly for bath or laundry tubs which provides an alternate piping arrangement to ensure proper drainage of water.

U.S. Pat. No. 2,780,241, issued in the name of Mustee, describes a waste and storage water control system for a laundry tub which provides a means for separate draining of an incoming water line and faucet water or the like.

U.S. Pat. No. 3,859,675, issued in the name of Van Manen et al., describes an interior overflow channel for a sink.

Additionally, ornamental designs for a water basin drain assembly exist, particularly U.S. Pat. Nos. D 175,850 and D 368,514. However, none of these designs are similar to the present invention.

While these devices fulfill their respective, particular objectives, each of these references suffer from one (1) or more of the aforementioned disadvantages. Many such devices are not easily adapted to freestanding laundry type basins. Also, many such devices are not adapted for handling debris or the like. Furthermore, many such devices occupy substantial amounts of space within the structure. In addition, many such devices are not easily accessible or replaceable. Accordingly, there exists a need for a laundry basin overflow assembly without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide simply overflow drainage to a laundry style basin in a manner which is compact, reliably functional, and maintainable. Thus, the object of the present invention is to solve the aforementioned disadvantages and provide for this need.

To achieve the above objectives, it is an object of the present invention to provide a laundry basin suitable for use with laundry machines and faucet assemblies. The apparatus comprises a basin assembly, an overflow drain, and a bottom drain assembly.

Another object of the present invention is to facilitate mounting of an existing faucet via a plurality of faucet mounting apertures integral to a top surface of the basin.

Yet still another object of the present invention is to provide overflow drainage capabilities via an overflow drain aperture located at an elevated position along a vertical wall of the basin assembly.

Yet still another object of the present invention is to provide drainage from the basin assembly via a bottom drain aperture in fluid communication with the bottom drain assembly. The basin is constructed to direct water flow to the bottom drain aperture via gravity.

Yet still another object of the present invention is to properly dispose of overflow water into an existing waste drain system via the bottom drain assembly.

Yet still another object of the present invention is to properly dispose of overflow water into an existing waste drain system via an overflow drain assembly attachable to the overflow drain aperture. The overflow water is routed from the overflow drain assembly to the bottom drain assembly.

Yet still another object of the present invention is to further comprise the drainage aperture of a bulkhead-type compression fitting which provides an attachment means to a flexible hose. The bottom drain assembly further comprises a bulkhead-type compression fitting which provides an attachment means to the opposite end of the hose. The hose is sealed to the fittings via a pair of hose clamps.

Yet still another object of the present invention is to maintain sufficient flow through the overflow drain via an integral overflow strainer across an inlet area of the flexible hose.

Yet still another object of the present invention is to provide a method of utilizing the device that provides a unique means of obtaining an instance of the apparatus of a desired size and aesthetic appearance, installing the bottom drain assembly, connecting the bottom drain assembly to an existing waste water drain system, connecting the overflow drain aperture to the bottom drain assembly via the flexible hose and hose clamps, installing an existing faucet assembly as desired, providing drainage to the basin via the bottom drain aperture, and allowing water to drain via the overflow drain assembly should the water level reach the height of the overflow drainage aperture.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
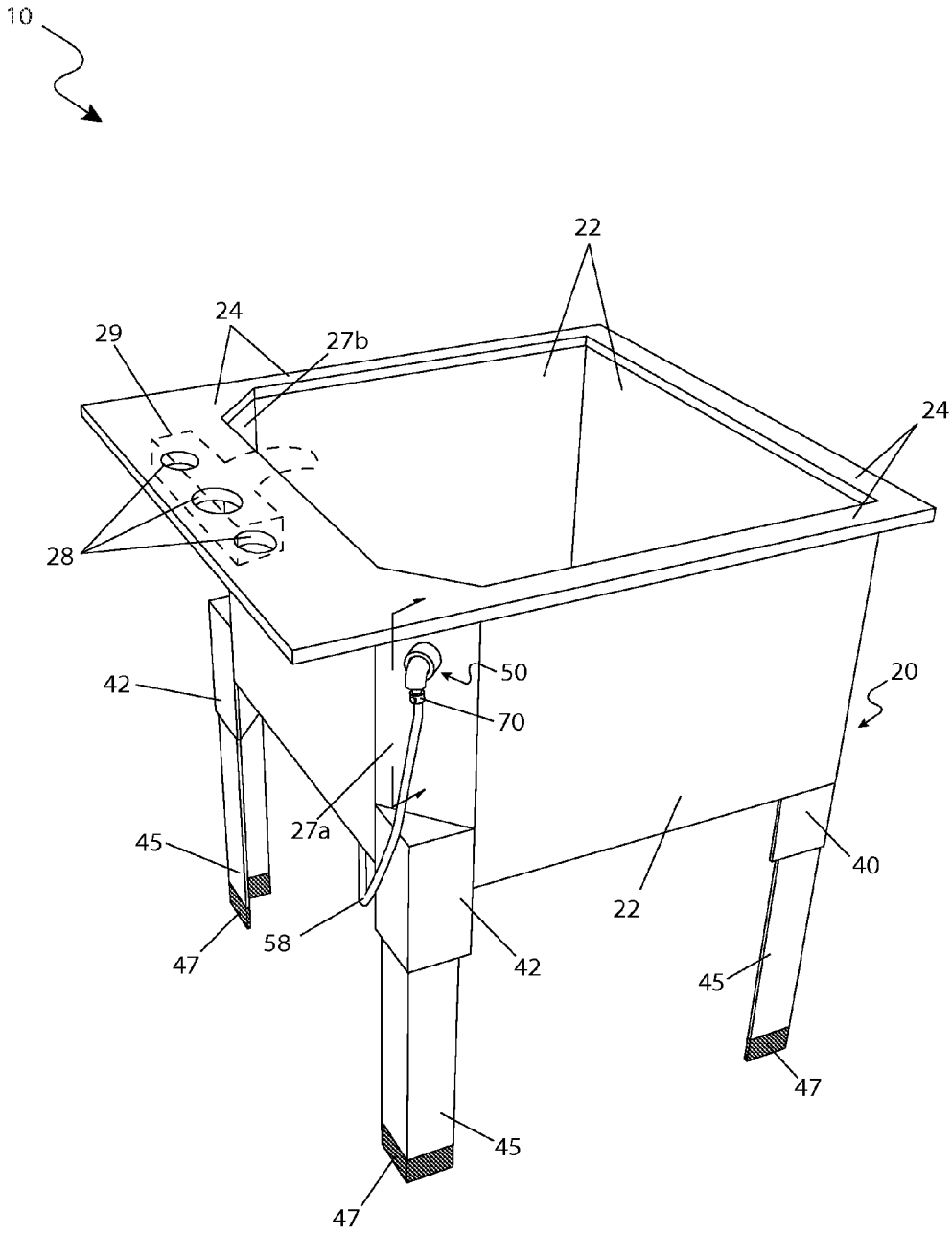
FIG. 1 is a side perspective view of a laundry basin with overflow drain 10, according to a preferred embodiment of the present invention.

10 laundry basin with overflow drain
20 basin assembly
22 basin sidewall
23 basin floor
24 top surface
25 recessed wall area
27*a* first beveled corner
27*b* second beveled corner
28 faucet mounting aperture
29 faucet
30 overflow drain aperture
32 bottom drain aperture
40 first leg socket
42 second leg socket
43 leg aperture
45 leg
47 foot
50 overflow drain assembly
51 elbow fitting
52 overflow drain plate
53 overflow strainer
55 first hose connector
56 gasket
58 hose
60 bottom drain assembly
62 bottom drain fitting
63 bottom drain strainer
64 bottom drain connector
66 tailpiece fitting
67 tailpiece collar
68 second hose connector
70 hose clamp
100 overflow water
110 waste drain system

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
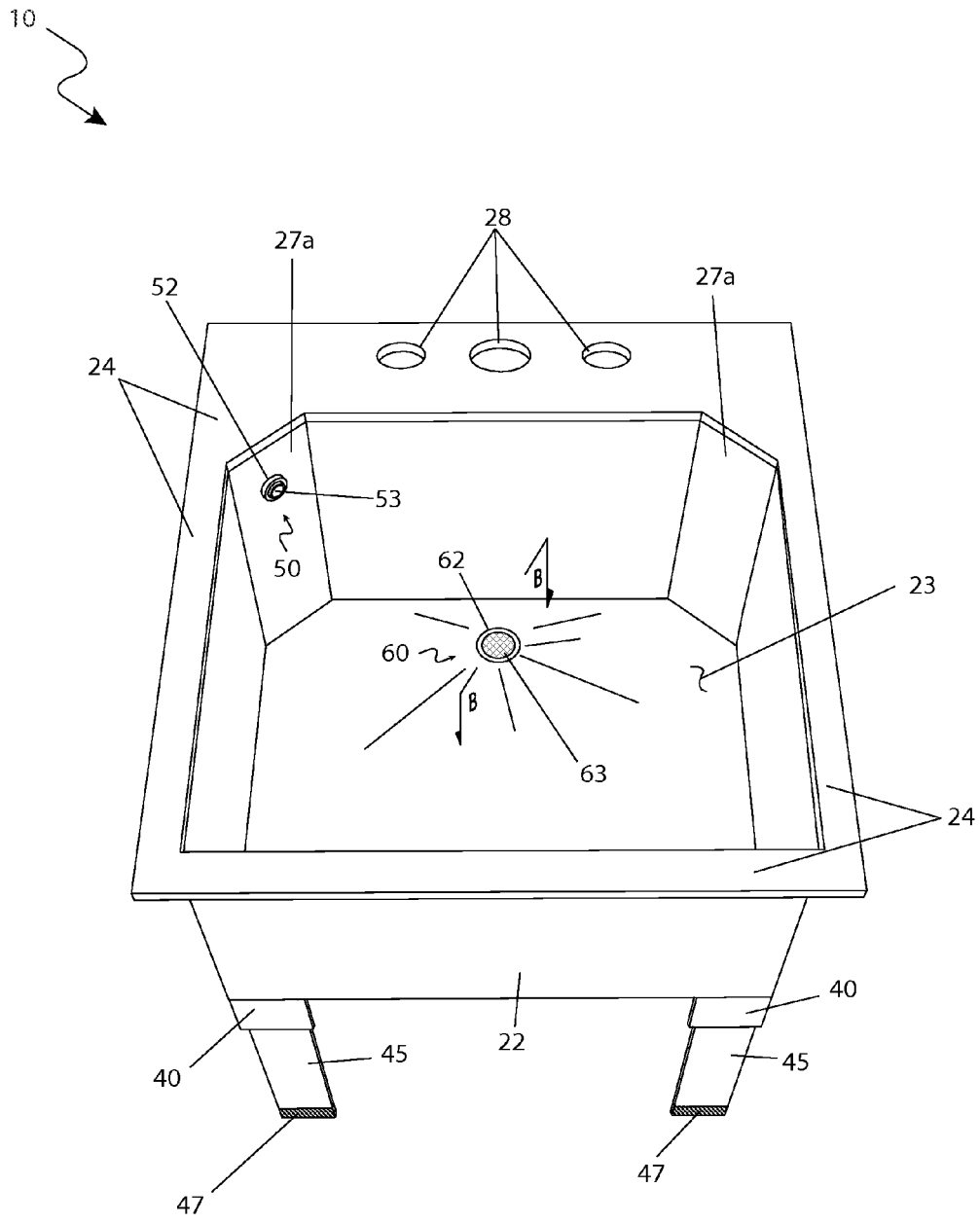
FIG. 2 is a top perspective view of a laundry basin with overflow drain 10, according to a preferred embodiment of the present invention.

Referring now to FIGS. 1 and 2, perspective views of the apparatus 10, according to the preferred embodiment of the present invention, are disclosed. The present invention describes a device and method for a laundry basin with overflow drain (herein described as the "apparatus") 10, which comprises a basin assembly 20, an overflow drain assembly 50, and a bottom drain assembly 60. The basin assembly 20 comprises a freestanding wash tub assembly further comprising a generally rectangular basin body comprising four (4) basin sidewalls 22 and a basin floor 23 having approximate dimensions of twenty (20) inches wide, fifteen (15) inches long, and fifteen (15) inches in depth. The basin body comprises two (2) rear corners which protrude inwardly along a vertical plane to form beveled corner portions 27*a*, 27*b*. The basin body further comprises a top surface 24 which extends horizontally outward from an entire upper perimeter edge being approximately two (2) inches wide at side areas and approximately four (4) inches wide along a back edge to facilitate mounting of a purchased faucet 29 via a plurality of faucet mounting apertures 28 being integral to the top surface 24. Said faucet mounting apertures 28 are envisioned to be sized and arranged in accordance with established plumbing standards. The basin body is preferably made in a molding process such as, but not limited to: injection molding, rotation molding, or the like, using materials such as plastic compounds, fiberglass, or equivalent compounds commonly used to produce similar low-pressure fluid vessels. It is envisioned that the basin assembly 20 may be introduced in a variety of colors and patterns to complement an existing décor.

In addition to the previously described features, the basin assembly 20 comprises an overflow drainage capability via an overflow drain aperture 30 being laterally centered at an elevated position along a vertical wall portion of a first beveled corner 27*a* portion of the basin sidewalls 22. The overflow drain aperture 30 provides insertion and attachment of an overflow drain assembly 50 to properly dispose of said overflow water 100 into an existing waste drain system 110 (see FIGS. 3 and 4).

As a water level inside the basin assembly 20 reaches a height of the overflow drain assembly 50, the excess overflow water 100 is diverted through said overflow drain assembly 50 and into a hose 58 rather than overflowing the basin assembly 20 and spilling out.

Figure 3:
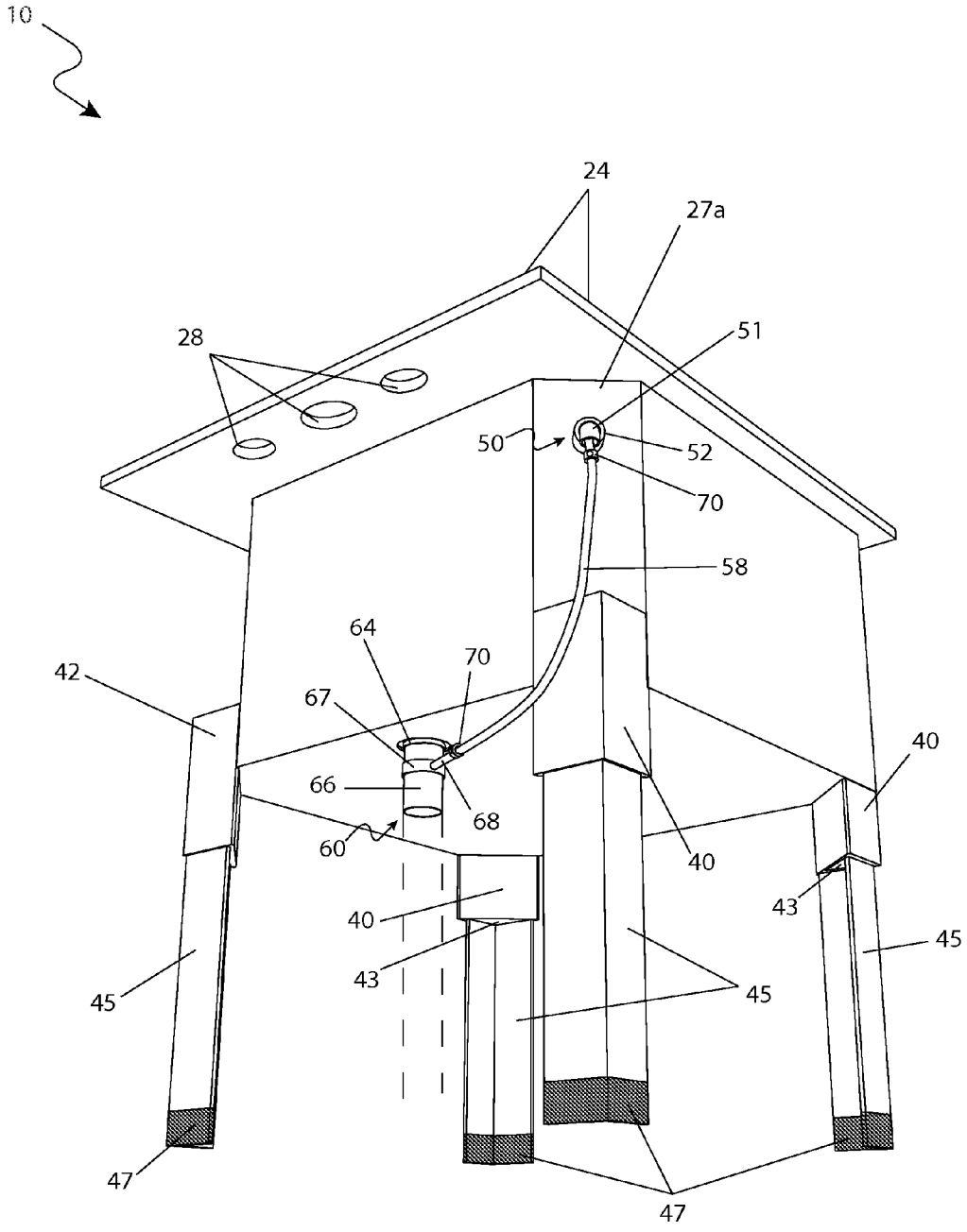
FIG. 3 is an upward-looking bottom perspective view of the laundry basin with overflow drain 10, according to a preferred embodiment of the present invention.

Referring now to FIG. 3, an upward-looking bottom perspective view of the apparatus 10, according to the preferred embodiment of the present invention, is disclosed. The apparatus 10 provides molded-in features which allow removable attachment of stabilizing leg portions 45 at each bottom corner location of the basin body. The apparatus 10 comprises a pair of integrally-molded first leg sockets 40 located at front corner locations of the apparatus 10 which protrude downwardly from a bottom surface of the basin body, Additionally, the basin body comprises a pair of integrally-molded second leg sockets 42 located at rear corner locations being molded in a vertical orientation into respective outer surfaces of each beveled corner portion 27*a*, 27*b*. Each leg socket 40, 42 comprises an internal square leg aperture 43 which extends upwardly from a bottom surface being approximately four (4) inches deep and sized so as to snuggly receive a leg portion 45 into said aperture 43. The legs 45 comprise two-sided structures made of plastic, fiberglass, or metal having a vertical right-angle form and a slight downward tapering profile. Furthermore, each leg 45 comprises a bottom-mounted rubber foot portion 47 which provides high-friction contact between said leg 45 and a supporting floor surface on which the apparatus 10 is placed. The foot portions 47 cover a bottom end portion of each leg 45 being pressed onto or affixed to using common industrial adhesives.

The basin body further comprises a bottom drain aperture 32 being located at a central position along the basin floor portion 23 providing an attachment means to the bottom drain assembly 60 which comprises similar construction and water draining function as the aforementioned overflow drain assembly 50. The basin floor 23 slopes downwardly toward said bottom drain assembly 60, thereby directing contained water into said bottom drain assembly 60 during drainage. The bottom drain assembly 60 comprises a bottom drain fitting 62 envisioned to provide an integral bottom drain strainer 63, a bottom drain connector 64, a circular gasket 56, a tailpiece fitting 66 having an integral second hose connector 68, and a tailpiece collar 67. The bottom drain assembly 60 provides a plumbing attachment means between the basin assembly 20 and an existing waste drain system 110, thereby routing the overflow water 100 from the aforementioned overflow drain assembly 50 into said waste drain system 110 via the a second hose connector portion 68 of the bottom drain assembly 60 (see FIG. 5).

Figure 4:
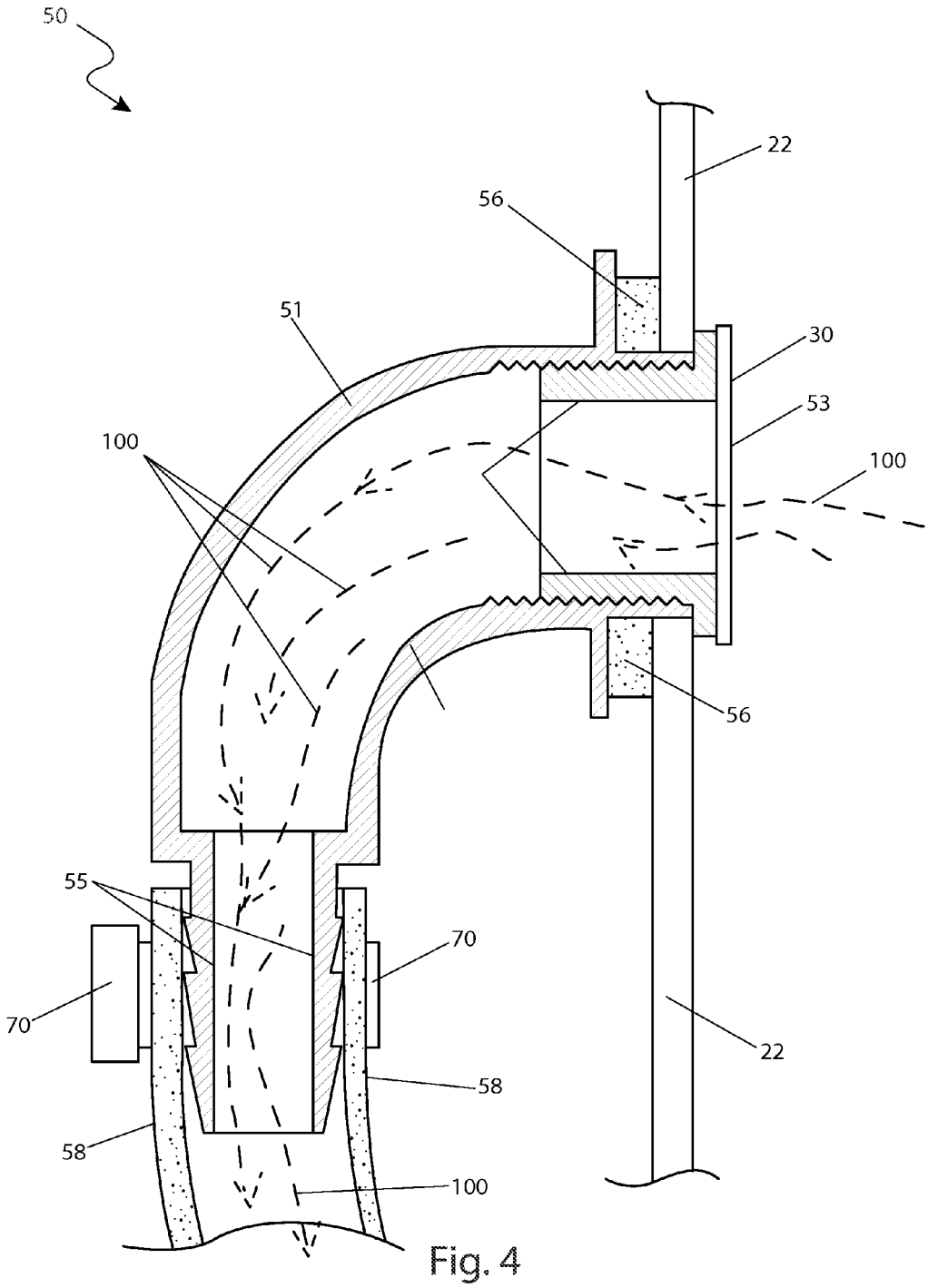
FIG. 4 is a section view of an overflow drain assembly portion 50 of the laundry basin with overflow drain 10 taken along section line A-A (see FIG. 1), according to a preferred embodiment of the present invention; and, FIG. 5 is a section view of a bottom drain assembly portion 60 of the laundry basin with overflow drain 10 taken along section line B-B (see FIG. 2), according to a preferred embodiment of the present invention.

Referring now to FIG. 4, a section view of an overflow drain assembly portion 50 of the apparatus 10 taken along section line A-A (see FIG. 1), according to a preferred embodiment of the present invention, is disclosed. The overflow drain assembly 50 provides a two-piece and threadingly joined bulkhead-type compression fitting further comprising an elbow fitting 51 and an overflow drain plate 52. A female threaded end portion of the elbow fitting 51 along with a circular sealing gasket 56 are positioned along an outer wall surface 22 of the basin body being aligned with an outer surface of the aforementioned overflow drain aperture 30. Subsequently, a male threaded portion of the overflow drain plate 52 is inserted through said overflow drain aperture 30 and threadingly attached thereto said elbow fitting 51 to complete the installation of the overflow drain assembly 50 to the basin assembly 20. The overflow drain plate 52 is envisioned to comprise an integral rough overflow strainer 53 across a front opening area to trap hair and other debris in a conventional manner. The elbow fitting 51 extends in an arcuate manner from the overflow drain aperture 30 downwardly and provides removable attachment of a length of common flexible hose 58 via an integral barbed first hose connector 55 and a standard hose clamp 70. The hose 58 routs any overflow water 100 which passes through said overflow drain assembly 50, to a bottom drain assembly 60 (see FIGS. 3 and 5).

It is envisioned that the component parts of the overflow drain assembly 50 are to be made of plastic or metal materials being manufactured in molding, stamping, machining, or other common fabrication processes or may comprise standard commercially available plumbing components and therefore may be purchased from a wholesale dealer.

Figure 5:
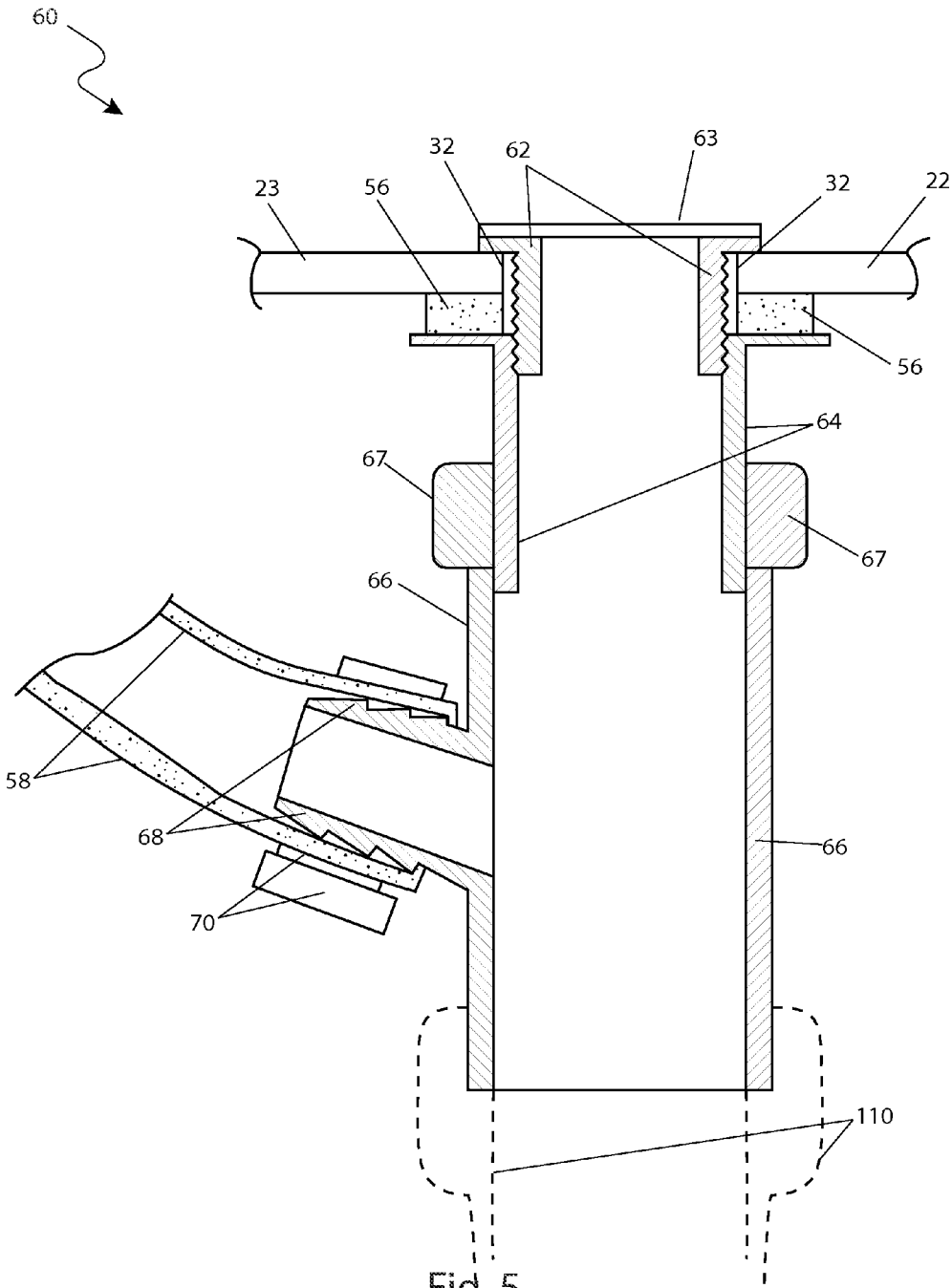

Referring now to FIG. 5, a section view of a bottom drain assembly portion 60 of the laundry basin with overflow drain 10 taken along section line B-B (see FIG. 2), according to a preferred embodiment of the present invention, is disclosed. The bottom drain connector 64 and gasket 56 portions of the bottom drain assembly 60 are pre-aligned with the bottom drain aperture 32 along a bottom surface of the basin floor 23. Subsequently, a male threaded portion of the bottom drain fitting 62 is inserted downwardly through said bottom drain aperture 32 and is threadingly engaged with a female threaded portion of the bottom drain connector 64, thereby providing a sealing means when tightened, between the bottom drain assembly 60 and the basin floor 23. The bottom drain connector 64 further comprises an integral straight tube portion which extends downwardly to provide an attachment means thereto the tailpiece fitting 66 via the tailpiece collar portion 67. Said tailpiece collar portion 67 comprises a conventional compression fitting having a threaded collar and an internal sealing ring, thereby providing adjustable vertical positioning and a secure sealed connection of said tailpiece fitting 66 along the straight tube portion of the bottom drain connector 64. The tailpiece fitting 66 further comprises an integrally-molded second hose connector 68 comprising a standard cylindrical barbed fitting which extends outwardly from a side surface of said tailpiece fitting 66, thereby enabling attachment of the hose 58 using a common hose clamp 70 (see FIG. 3).

It is envisioned that the component parts of the bottom drain assembly 60 are made of plastic or metal materials being manufactured in molding, stamping, machining, or other common fabrication processes or may comprise standard commercially available plumbing components and therefore may be purchased from a wholesale dealer.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition it is envisioned of the apparatus 10, would be installed by a plumber or other qualified professional as indicated in FIGS. 1 through 3.

The method of installing and utilizing the apparatus 10 may be achieved by performing the following steps: procuring the apparatus 10 having a desired color and/or pattern to match an existing décor; inserting the four (4) leg portions 45 into the leg sockets 40, 42; mounting the overflow drain assembly 50 to the overflow drain aperture 30 portion of the basin sidewall 22 being laterally centered upon the first beveled corner 27*a* using conventional plumbing methods and tools, if not previously installed; mounting the bottom drain assembly 60 to the bottom drain aperture 32 located in the basin floor 23 using conventional plumbing techniques and tools, if not previously installed; connecting said bottom drain assembly 60 to the existing waste water drain system 110 using conventional piping joining methods; slipping end portions of the hose 58 onto the first 55 and second 68 hose connectors and securing said hose 58 therebetween using the hose clamps 70; installing a purchased faucet 29 to the faucet mounting aperture portions 28 and connecting said faucet 29 to an existing water supply system using conventional plumbing methods; utilizing the apparatus 10 to perform common tasks such as disposing of wash water, performing various washing tasks, pre-soaking laundry items, and the like; routing excess overflow water 100 through the overflow drain assembly 50 when a contained water level reaches a level of the overflow drain assembly 50; utilizing the apparatus 10 to continue to direct said water 100 entering the overflow drain assembly 50, through the hose 58, the bottom drain assembly 60, and into the existing waste drain system 110; and, benefiting from redirection and proper disposal of overflow water 100 to a waste drain system 110 using the present invention 10, which would otherwise spill out onto a floor surface.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A laundry basin, comprising:

a basin assembly, comprising a unitary wash tub assembly further comprising:

an interior;

a basin body comprising sidewalls and a basin floor, said basin floor gently sloping inwardly towards a central rear location;

a top surface extending outwardly horizontal along an upper perimeter edge of said basin sidewalls, further comprising a rear area comprising a mounting means for a faucet;

two first leg sockets depending downwardly from a bottom portion of two front corners of said basin floor;

two rear corners protruding inwardly along a vertical plane to form a first beveled corner portion and a second beveled corner portion, each at an upper portion;

two second leg sockets vertically depending downward from a bottom portion of said two rear corners of said basin floor;

four leg portions, each removably inserted to said two first leg sockets and said two second leg sockets;

an overflow drain aperture laterally centered at an elevated position along a vertical wall portion of said first beveled corner portion; and, a bottom drain aperture located at said central rear location of said basin floor;

a bottom drain assembly located at a bottom portion of said basin assembly and in fluid communication with said interior, further comprising:

a bottom drain fitting, in fluid communication with said interior, comprising a top end and a bottom end, wherein said bottom end is inserted through said bottom drain aperture such that a flange of said top end abuts an upper surface of said basin floor;

a bottom drain strainer integral with said top end of said bottom drain fitting;

a bottom drain connector, in fluid communication with said bottom drain fitting, comprising a tubular member having a top end removably attached to said bottom end of said bottom drain fitting, a shoulder along a top perimeter edge of said top end, and a bottom end;

a gasket disposed between a bottom surface of said basin floor and a shoulder of said bottom drain connector;

a tailpiece fitting comprising a tubular member and having an integral hose connector removably attachable to and in fluid communication with said overflow drain assembly; and, a tailpiece collar for removably attaching said tailpiece fitting to said bottom drain connector; and, an overflow drain assembly located at an upper portion of said basin assembly and in fluid communication with interior and said bottom drain assembly;

wherein said overflow drain assembly is located at a height of said basin assembly, such that liquid contents are directed through said overflow drain assembly when reaching said height within said interior;

wherein said bottom drain assembly directs liquid contents away from said interior;

wherein each of said two first leg sockets and said two second leg sockets have an upper stop upon which each of said four leg portions abut when inserted therein;

wherein said four leg portions stabilize and support said basin assembly upon a ground surface;

wherein said bottom drain strainer strains unwanted debris from entering said bottom drain aperture;

wherein mating of said bottom drain connector to said bottom drain fitting with said gasket provides a liquid seal to said basin assembly;

wherein said tailpiece fitting is in fluid communication with said bottom drain connector; and, wherein said tailpiece fitting directs said liquid contents away from said basin assembly.

2. The laundry basin of claim 1, wherein each of said leg portions further comprise a bottom-mounted rubber foot portion attached to a lower end to provides a high-friction contact between said leg and said ground surface.

3. The laundry basin of claim 1, wherein said basin assembly further comprises approximate dimensions of approximately twenty inches in width, approximately fifteen inches in length, and approximately fifteen inches in depth.

4. The laundry basin of claim 1, wherein said top surface extends approximately two inches in width along side edges and approximately four inches in width along said rear edge vessels.

5. The laundry basin of claim 1, wherein said tailpiece fitting further comprises a compression fitting having a threaded collar and an internal sealing ring, thereby providing adjustable vertical positioning and a secure sealed connection of said tailpiece fitting to said bottom drain connector.

6. The laundry basin of claim 1, wherein said overflow drain assembly comprises:

an overflow drain plate, comprising a first end and a second end, wherein said second end is inserted through said overflow drain aperture such that a flange of said first end abuts an inner surface of said first beveled corner portion;

an overflow drain strainer integral with said first end of said overflow drain plate;

an elbow fitting, comprising a tubular member having a top end removably attached to said second end of said overflow drain plate, a shoulder along a top perimeter edge of said top end, and a bottom end;

a gasket disposed between a outer surface of said first beveled corner portion and a shoulder of said elbow fitting; and, a hose, comprising an upper end removably attached to and in fluid communication with said elbow fitting and a lower end removably attached to and in fluid communication with said bottom drain assembly;

wherein said overflow drain strainer strains unwanted debris from entering said overflow drain aperture;

wherein mating of said elbow fitting to said overflow drain plate with said gasket provides a liquid seal to said basin assembly;

wherein said overflow drain plate is in fluid communication with said interior;

wherein said elbow fitting is in fluid communication with said overflow drain plate; and, wherein said hose conveys said liquid contents to said bottom drain assembly.

7. A laundry basin, comprising:

a generally rectangular basin assembly, comprising a unitary wash tub assembly further comprising:

an interior;

a generally rectangular basin body comprising four basin sidewalls and a basin floor, said basin floor gently sloping inwardly towards a central rear location;

a top surface extending outwardly horizontal along an upper perimeter edge of said four basin sidewalls, further comprising a rear area comprising a mounting means for a faucet;

two first leg sockets depending downwardly from a bottom portion of two front corners of said basin floor;

two rear corners protruding inwardly along a vertical plane to form a first beveled corner portion and a second beveled corner portion, each at an upper portion;

two second leg sockets vertically depending downward from a bottom portion of said two rear corners of said basin floor;

four leg portions, each removably inserted to said two first leg sockets and said two second leg sockets;

an overflow drain aperture laterally centered at an elevated position along a vertical wall portion of said first beveled corner portion; and, a bottom drain aperture located at said central rear location of said basin floor;

a bottom drain assembly located at a bottom portion of said basin assembly and in fluid communication with said interior, further comprising:

a bottom drain fitting, in fluid communication with said interior, comprising a top end and a bottom end, wherein said bottom end is inserted through said bottom drain aperture such that a flange of said top end abuts an upper surface of said basin floor;

a bottom drain strainer integral with said top end of said bottom drain fitting;

a bottom drain connector, in fluid communication with said bottom drain fitting, comprising a tubular member having a top end removably attached to said bottom end of said bottom drain fitting, a shoulder along a top perimeter edge of said top end, and a bottom end;

a gasket disposed between a bottom surface of said basin floor and a shoulder of said bottom drain connector;

a tailpiece fitting comprising a tubular member and having an integral hose connector removably attachable to and in fluid communication with said overflow drain assembly; and, a tailpiece collar for removably attaching said tailpiece fitting to said bottom drain connector; and, an overflow drain assembly located at an upper portion of said basin assembly and in fluid communication with interior and said bottom drain assembly;

wherein said overflow drain assembly is located at a height of said basin assembly, such that liquid contents are directed through said overflow drain assembly when reaching said height within said interior;

wherein each of said two first leg sockets and said two second leg sockets have an upper stop upon which each of said four leg portions abut when inserted therein;

wherein said four leg portions provide stabilize and support said basin assembly upon a ground surface;

wherein said bottom drain assembly directs liquid contents away from said interior;

wherein said bottom drain strainer strains unwanted debris from entering said bottom drain aperture;

wherein mating of said bottom drain connector to said bottom drain fitting with said gasket provides a liquid seal to said basin assembly;

wherein said tailpiece fitting is in fluid communication with said bottom drain connector; and, wherein said tailpiece fitting directs said liquid contents away from said basin assembly.

8. The laundry basin of claim 7, wherein each of said leg portions further comprise a bottom-mounted rubber foot portion attached to a lower end to provides a high-friction contact between said leg and said ground surface.

9. The laundry basin of claim 7, wherein said basin assembly further comprises approximate dimensions of approximately twenty inches in width, approximately fifteen inches in length, and approximately fifteen inches in depth.

10. The laundry basin of claim 7, wherein said top surface extends approximately two inches in width along side edges and approximately four inches in width along said rear edge vessels.

11. The laundry basin of claim 7, wherein said tailpiece fitting further comprises a compression fitting having a threaded collar and an internal sealing ring, thereby providing adjustable vertical positioning and a secure sealed connection of said tailpiece fitting to said bottom drain connector.

12. The laundry basin of claim 7, wherein said overflow drain assembly comprises:

an overflow drain plate, comprising a first end and a second end, wherein said second end is inserted through said overflow drain aperture such that a flange of said first end abuts an inner surface of said first beveled corner portion;

an overflow drain strainer integral with said first end of said overflow drain plate;

an elbow fitting, comprising a tubular member having a top end removably attached to said second end of said overflow drain plate, a shoulder along a top perimeter edge of said top end, and a bottom end;

a gasket disposed between a outer surface of said first beveled corner portion and a shoulder of said elbow fitting; and, a hose, comprising an upper end removably attached to and in fluid communication with said elbow fitting and a lower end removably attached to and in fluid communication with said bottom drain assembly;

wherein said overflow drain strainer strains unwanted debris from entering said overflow drain aperture;

wherein mating of said elbow fitting to said overflow drain plate with said gasket provides a liquid seal to said basin assembly;

wherein said overflow drain plate is in fluid communication with said interior;

wherein said elbow fitting is in fluid communication with said overflow drain plate; and, wherein said hose conveys said liquid contents to said bottom drain assembly.

* * * * *